US007624517B2

(12) United States Patent
Smith

(10) Patent No.: US 7,624,517 B2
(45) Date of Patent: Dec. 1, 2009

(54) ARTICLE OF FOOTWEAR WITH SADDLE

(75) Inventor: Steven F. Smith, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 686 days.

(21) Appl. No.: 11/419,014

(22) Filed: May 18, 2006

(65) Prior Publication Data

US 2007/0266594 A1 Nov. 22, 2007

(51) Int. Cl.
*A43C 11/00* (2006.01)
*A43B 23/00* (2006.01)

(52) U.S. Cl. ..... 36/50.1; 36/53

(58) Field of Classification Search ..... 36/50.1, 36/225, 89–92, 170, 45, 51–53, 114
See application file for complete search history.

(56) References Cited

U.S. PATENT DOCUMENTS

| | | | | |
|---|---|---|---|---|
| 459,616 | A | 9/1891 | Rohonczy | |
| 702,476 | A | 6/1902 | Price | |
| 1,155,506 | A | 10/1915 | Osaki | |
| 2,147,197 | A * | 2/1939 | Glidden | 36/9 R |
| 2,741,039 | A | 4/1956 | Mathews | |
| 3,408,754 | A | 11/1968 | Kueter | |
| D228,267 | S | 9/1973 | Powers | |
| 3,768,182 | A | 10/1973 | Powers | |
| 4,132,016 | A | 1/1979 | Vaccari | |
| 4,447,967 | A * | 5/1984 | Zaino | 36/45 |
| 4,461,288 | A | 7/1984 | Curtis | |
| 4,547,981 | A | 10/1985 | Thais et al. | |
| 4,649,939 | A | 3/1987 | Curtis | |
| 4,670,998 | A | 6/1987 | Pasternak | |
| 4,817,303 | A | 4/1989 | Selbiger | |
| 4,989,350 | A | 2/1991 | Bunch et al. | |
| D325,120 | S * | 4/1992 | Clark | D2/969 |
| 5,175,947 | A | 1/1993 | Parracho | |
| 5,243,772 | A | 9/1993 | Francis et al. | |
| 5,291,671 | A | 3/1994 | Caberlotto et al. | |
| 5,377,430 | A | 1/1995 | Hatfield et al. | |
| 5,408,761 | A | 4/1995 | Gazzano | |

(Continued)

FOREIGN PATENT DOCUMENTS

EP 0970629 A1 1/2000

OTHER PUBLICATIONS

PCT/US2007/067992—International Search Report.

*Primary Examiner*—Jila M Mohandesi
(74) *Attorney, Agent, or Firm*—Banner & Witcoff, Ltd.

(57) ABSTRACT

An article of footwear includes an upper having a tongue opening and a sole assembly secured to the upper. A saddle has a first portion having a lower edge secured to at least one of the upper and the sole assembly in a midfoot portion of the upper and sole assembly, and an upper edge wrapped over the tongue opening. A second portion has a lower edge secured to at least one of the upper and the sole assembly in a midfoot portion of the upper and sole assembly, and an upper edge wrapped over the tongue opening and secured to the upper. A heel strap is connected to the first portion and the second portion and extends about the upper. The saddle is free from the upper at all locations other than the lower and upper edges of the first and second portions.

15 Claims, 2 Drawing Sheets

U.S. PATENT DOCUMENTS

| | | | |
|---|---|---|---|
| 5,497,564 | A | 3/1996 | Allen et al. |
| 5,692,319 | A | 12/1997 | Parker et al. |
| 5,692,320 | A | 12/1997 | Nichols |
| 6,151,804 | A | 11/2000 | Hieblinger |
| 6,298,582 | B1 | 10/2001 | Friton et al. |
| 2004/0205982 | A1 | 10/2004 | Challe |
| 2005/0126042 | A1 | 6/2005 | Baier et al. |

* cited by examiner

ARTICLE OF FOOTWEAR WITH SADDLE

FIELD OF THE INVENTION

This invention relates generally to footwear, and, in particular, to an article of footwear having a saddle.

BACKGROUND OF THE INVENTION

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running. Eyelets are typically provided on the upper about a tongue opening. Laces threaded through the eyelets are tightened and tied in a knot, securing the upper about the user's foot.

The sole structure of athletic footwear generally exhibits a layered configuration that may include a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane, which compress resiliently under an applied load to attenuate ground reaction forces created by the impacts of running and jumping. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities. The compression of the foam is affected by hysteresis loss, and deflection of such systems is affected by the volume of the compressed mass of the midsole.

It would be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with a saddle. In accordance with a first aspect, an article of footwear includes an upper having a tongue opening and a sole assembly secured to the upper. A saddle has a first portion having a lower edge secured to at least one of the upper and the sole assembly in a midfoot portion of the upper and sole assembly, and an upper edge wrapped over the tongue opening. A second portion has a lower edge secured to at least one of the upper and the sole assembly in a midfoot portion of the upper and sole assembly, and an upper edge wrapped over the tongue opening and secured to the upper. A heel strap is connected to the first portion and the second portion and extends about the upper. The saddle is free from the upper at all locations other than the lower and upper edges of the first and second portions.

In accordance with another aspect, an article of footwear includes an upper having a tongue opening. A tongue is positioned in the tongue opening and is secured to the upper. A sole assembly is secured to the upper. A saddle has a first portion on a medial side of the upper with a lower edge secured to at least one of the upper and the sole assembly in a midfoot portion of the upper and sole assembly. An upper edge of the first portion is wrapped over a medial edge of the tongue opening and is secured to the upper. A plurality of first apertures is formed in the first portion proximate the upper edge and define eyelets between adjacent first apertures when the upper edge is wrapped over the medial edge of the tongue opening. A second portion of the saddle on a lateral side of the upper has a lower edge secured to at least one of the upper and the sole assembly in a midfoot portion of the upper and sole assembly. An upper edge of the second portion is wrapped over a medial edge of the tongue opening and is secured to the upper. A plurality of second apertures is formed in the second portion proximate the upper edge and define eyelets between adjacent second apertures when the upper edge is wrapped over the lateral edge of the tongue opening. A heel strap has a first end connected to the first portion and a second end connected to the second portion, with the heel strap extending about a heel portion of the upper. The saddle is free from the upper at all locations other than the lower and upper edges of the first and second portions.

In accordance with a further aspect, an article of footwear includes an upper having a tongue opening. A tongue is positioned in the tongue opening and is secured to the upper. A sole assembly is secured to the upper. A saddle has a first portion on a medial side of the upper having a lower edge secured to at least one of the upper and the sole assembly in a midfoot portion of the upper and sole assembly, and an upper edge that is wrapped over a medial edge of the tongue opening and secured to the upper by stitching. A plurality of first apertures is formed in the first portion proximate the upper edge and define eyelets between adjacent first apertures when the upper edge is wrapped over the medial edge of the tongue opening. A second portion of the saddle on a lateral side of the upper has a lower edge secured to at least one of the upper and the sole assembly in a midfoot portion of the upper and sole assembly, and an upper edge that is wrapped over a medial edge of the tongue opening and secured to the upper by stitching. A plurality of second apertures in the second portion proximate the upper edge define eyelets between adjacent second apertures when the upper edge is wrapped over the lateral edge of the tongue opening. A heel strap has a first end connected to the first portion and a second end connected to the second portion, with the heel strap extending about a heel portion of the upper. The heel strap, first portion, and second portion are of unitary construction. The saddle is free from the upper at all locations other than the lower and upper edges of the first and second portions.

Substantial advantage is achieved by providing an article of footwear with a saddle. In particular, certain embodiments of an article of footwear with a saddle allow a user to more securely fasten the footwear about their foot, providing improved fit and increased comfort.

These and additional features and advantages disclosed here will be further understood from the following detailed disclosure of certain embodiments.

Figure 1:
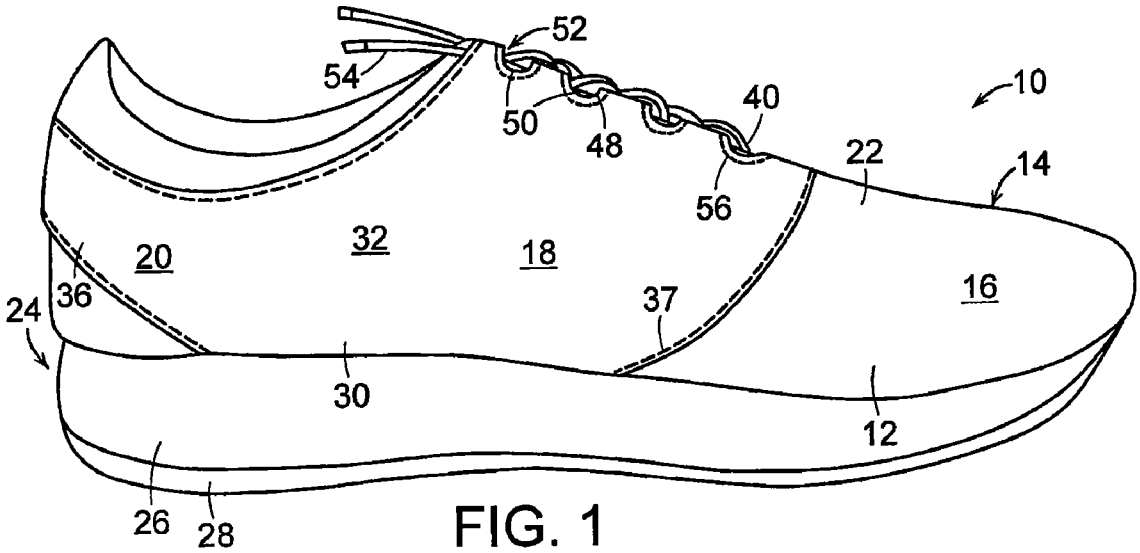
FIG. 1 is a perspective view of an article of footwear with a saddle.

The figures referred to above are not drawn necessarily to scale and should be understood to provide a representation of the invention, illustrative of the principles involved. Some features of the article of footwear depicted in the drawings have been enlarged or distorted relative to others to facilitate explanation and understanding. The same reference numbers are used in the drawings for similar or identical components and features shown in various alternative embodiments. Articles of footwear as disclosed herein would have configurations and components determined, in part, by the intended application and environment in which they are used.

DETAILED DESCRIPTION OF CERTAIN PREFERRED EMBODIMENTS

Figure 2:
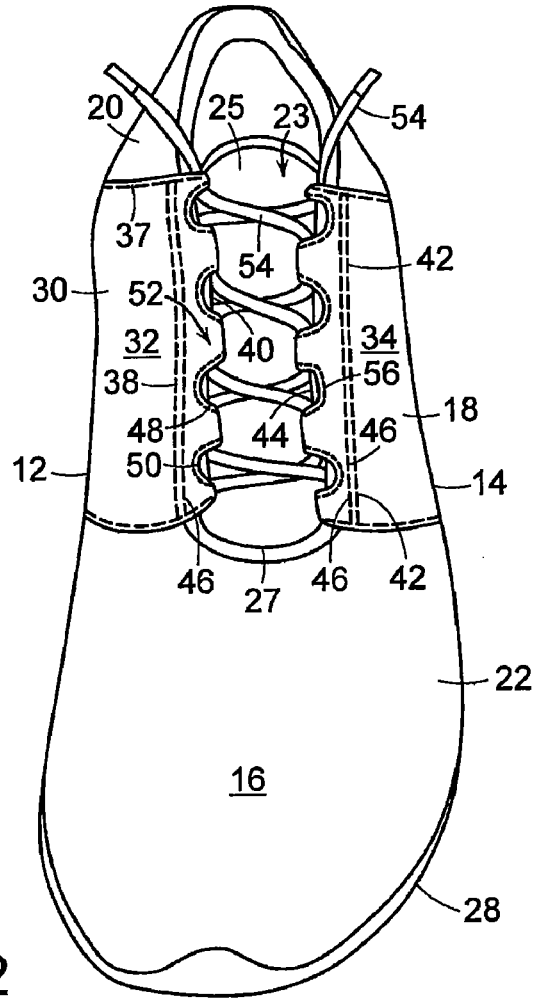
FIG. 2 is a plan view of the article of footwear of FIG. 1.
Figure 3:
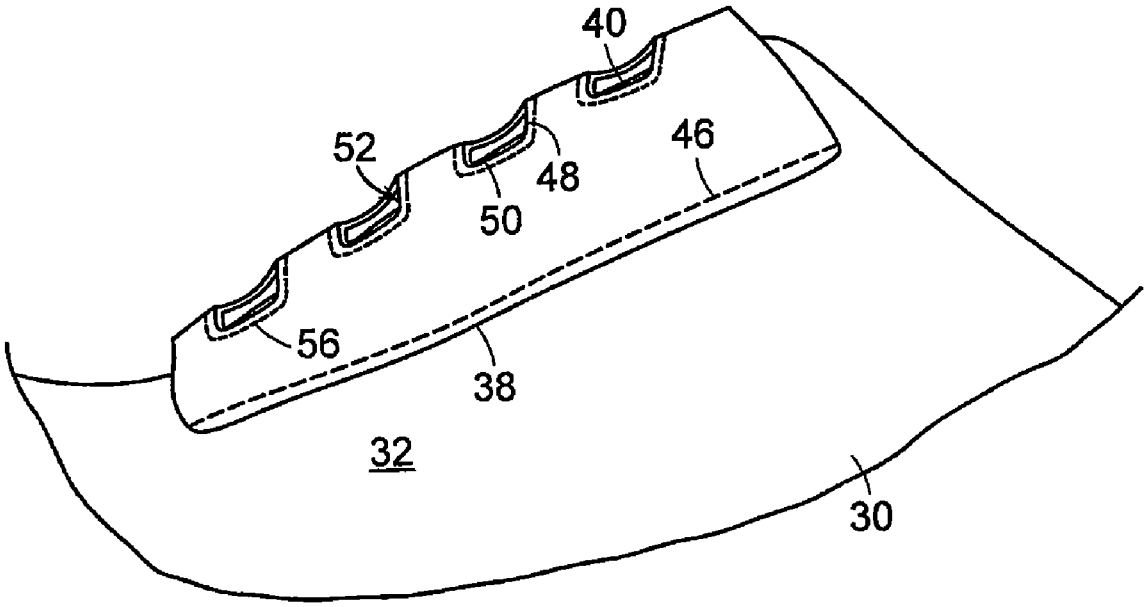
FIG. 3 is a close up view of the inside of the eyelets of the article of footwear of FIG. 1.

The present invention may be embodied in various forms. A preferred embodiment of an article of footwear 10 is shown in FIGS. 1-3. Footwear 10 has a medial, or inner, side 12 and a lateral, or outer, side 14. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion. The figures illustrate only the article of footwear intended for use on the right foot of a wearer. One skilled in the art will recognize that a left article of footwear, such article being the mirror image of the right, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1.

Naturally, forwardly is toward forefoot portion 16, that is, to the right as seen in FIG. 1, and downwardly is toward the bottom of the page as seen in FIG. 1. Inwardly is toward the center of footwear 10, and outwardly is toward the outer peripheral edge of footwear 10.

Footwear 10 includes an upper 22, and a sole assembly 24 secured to upper 22. Upper 22 includes a tongue opening 23, within which a tongue 25 is positioned. A lower edge 27 of tongue 25 is secured to upper 22 by stitching or other suitable fastening means. In certain embodiments, tongue 25 may be of unified, that is, one-piece construction with upper 22.

Upper 22 forms an interior void that comfortably receives a foot and secures the position of the foot relative to sole assembly 24. The configuration of upper 22, as depicted, is suitable for use during athletic activities that primarily involve running. Accordingly, upper 22 may have a lightweight, breathable construction that includes multiple layers of leather, textile, polymer, and foam elements adhesively bonded and stitched together. For example, upper 22 may have an exterior that includes leather elements and textile elements for resisting abrasion and providing breathability, respectively. The interior of upper 22 may have foam elements for enhancing the comfort of footwear 10, and the interior surface may include a moisture-wicking textile for removing excess moisture from the area immediately surrounding the foot.

Sole assembly 24 may be secured to upper 22 by an adhesive, or any other suitable fastening means. Sole assembly 24, which is generally disposed between the foot of the wearer and the ground, provides attenuation of ground reaction forces (i.e., imparting cushioning), traction, and may control foot motions, such as pronation. As with conventional articles of footwear, sole assembly 24 includes an insole (not shown) located within upper 12, a midsole 26, and an outsole 28. Midsole 26 is attached to upper 22 and functions as the primary shock-attenuating and energy-absorbing component of footwear 10. Suitable materials for outsole 28 include traditional rubber materials. Other suitable materials for outsole 28 will become readily apparent to those skilled in the art, given the benefit of this disclosure.

A saddle 30 is secured to footwear 10 and extends about upper 22. Saddle 30 has a first portion 32 on medial side 12 of upper 22, a second portion 34 on lateral side 14 of upper 22, and a heel strap 36 extending about heel portion 20 of upper 22 and connected at its first end to first portion 32 and at its second end to second portion 34. Although saddle 30 is described here as having three portions, it may be, as it is depicted in this embodiment, of unitary construction. A lower edge of first portion 32 and a lower edge of second portion 34 are secured to one or both of upper 22 and sole assembly 24 by adhesive, stitching or other suitable means.

Saddle 30 may be a sheet of any man-made or natural material including, for example, leather, or nylon.

In the illustrated embodiment, stitching 37 is provided along respective upper and lower edges of first portion 32, second portion 34, and heel strap 36 in order to reinforce saddle 30.

An upper edge 38 of first portion 32 is wrapped over a medial edge 40 of tongue opening 23 and an upper edge 42 of second portion 34 is wrapped over a lateral edge 44 of tongue opening 23 as best seen in FIG. 3 with respect to first portion 32. Upper edges 38, 42 are secured to upper 12 with stitching 46, adhesive or other suitable means.

Apertures 48 are formed in first portion 32 and second portion 34. Apertures 48 are positioned such that when upper edge 38 is wrapped over medial edge 40 of tongue opening 23, apertures 48 are folded over onto themselves to define substantially U-shaped notches 50. Similarly, apertures 48 are positioned such that when upper edge 42 is wrapped over lateral edge 44 of tongue opening 23, apertures 48 are folded over onto themselves to define substantially U-shaped notches 50. The folded over portions of upper edges 38, 42 between notches 50 define eyelets 52, through which laces 54 are threaded. Stitching 56 may be provided about each aperture 48, thereby providing reinforcing for laces 54.

When a user tightens and ties laces 54, saddle 30, being secured at lower edges thereof to upper 12, serves to tighten upper about the user's entire foot, rather than just across the bridge of the foot as is the case when the laces of a typical shoe are tightened. This provides a better fit and increased comfort for the user.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper having a tongue opening;

a sole assembly secured to the upper; and a saddle having:

a first portion on a medial side of the upper having a lower edge secured to at least one of the upper and the sole assembly in a midfoot portion of the upper and sole assembly, and an upper edge wrapped over a medial edge of the tongue opening and secured to an interior surface of the upper;

a second portion on a lateral side of the upper having a lower edge secured to at least one of the upper and the sole assembly in a midfoot portion of the upper and sole assembly, and an upper edge wrapped over a medial edge of the tongue opening and secured to an interior surface of the upper; and a heel strap having a first end connected to the first portion and a second end connected to the second portion, the heel strap extending about a heel portion of the upper, the saddle being free from the upper at all locations other than the lower and upper edges of the first and second portions.

2. The article of footwear of claim 1, further comprising a plurality of first apertures proximate the upper edge of the first portion and a plurality of second apertures proximate the upper edge of the second portion.

3. The article of footwear of claim 2, further comprising eyelets formed between adjacent first and second apertures when the upper edge of the first portion and the upper edge of the second portion are wrapped over the tongue opening.

4. The article of footwear of claim 2, further comprising stitching about each first aperture and about each second aperture.

5. The article of footwear of claim 1, further comprising stitching along exposed edges of the first portion, the second portion, and the heel strap.

6. The article of footwear of claim 1, wherein the upper edge of the first portion and the upper edge of the second portion are secured to the upper with stitching.

7. The article of footwear of claim 1, further comprising a tongue positioned in the tongue opening and secured to the upper.

8. The article of footwear of claim 1 wherein the heel strap, first portion, and second portion are of unitary construction.

9. An article of footwear comprising, in combination:

an upper having a tongue opening;

a tongue positioned in the tongue opening and secured to the upper;

a sole assembly secured to the upper; and a saddle having:

a first portion on a medial side of the upper having a lower edge secured to at least one of the upper and the sole assembly in a midfoot portion of the upper and sole assembly, and an upper edge wrapped over a medial edge of the tongue opening and secured to an interior surface of the upper;

a plurality of first apertures in the first portion proximate the upper edge and defining eyelets between adjacent first apertures when the upper edge is wrapped over the medial edge of the tongue opening;

a second portion on a lateral side of the upper having a lower edge secured to at least one of the upper and the sole assembly in a midfoot portion of the upper and sole assembly, and an upper edge wrapped over a medial edge of the tongue opening and secured to an interior surface of the upper;

a plurality of second apertures in the second portion proximate the upper edge and defining eyelets between adjacent second apertures when the upper edge is wrapped over the lateral edge of the tongue opening; and a heel strap having a first end connected to the first portion and a second end connected to the second portion, the heel strap extending about a heel portion of the upper;

wherein the saddle is free from the upper at all locations other than the lower and upper edges of the first and second portions.

10. The article of footwear of claim 9, further comprising stitching about each first aperture and about each second aperture.

11. The article of footwear of claim 9, further comprising stitching along exposed edges of the first portion, the second portion, and the heel strap.

12. The article of footwear of claim 9, wherein the heel strap, first portion, and second portion are of unitary construction.

13. An article of footwear comprising, in combination:

an upper having a tongue opening;

a tongue positioned in the tongue opening and secured to the upper;

a sole assembly secured to the upper; and a saddle having:

a first portion on a medial side of the upper having a lower edge secured to at least one of the upper and the sole assembly in a midfoot portion of the upper and sole assembly, and an upper edge wrapped over a medial edge of the tongue opening and secured to an interior surface of the upper by stitching;

a plurality of first apertures in the first portion proximate the upper edge and defining eyelets between adjacent first apertures when the upper edge is wrapped over the medial edge of the tongue opening;

a second portion on a lateral side of the upper having a lower edge secured to at least one of the upper and the sole assembly in a midfoot portion of the upper and sole assembly, and an upper edge wrapped over a medial edge of the tongue opening and secured to an interior surface of the upper by stitching;

a plurality of second apertures in the second portion proximate the upper edge and defining eyelets between adjacent second apertures when the upper edge is wrapped over the lateral edge of the tongue opening; and a heel strap having a first end connected to the first portion and a second end connected to the second portion, the heel strap extending about a heel portion of the upper, the heel strap, first portion, and second portion being of unitary construction;

wherein the saddle is free from the upper at all locations other than the lower and upper edges of the first and second portions.

14. The article of footwear of claim 13, further comprising stitching about each first aperture and about each second aperture.

15. The article of footwear of claim 13, further comprising stitching along exposed edges of the first portion, the second portion, and the heel strap.

* * * * *

UNITED STATES PATENT AND TRADEMARK OFFICE

CERTIFICATE OF CORRECTION

PATENT NO. : 7,624,517 B2
APPLICATION NO. : 11/419014
DATED : December 1, 2009
INVENTOR(S) : Steven F. Smith It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 867 days.

Signed and Sealed this

Twenty-sixth Day of October, 2010

David J. Kappos

David J. Kappos
*Director of the United States Patent and Trademark Office*